US006153978A

United States Patent [19]

Okamoto

[11] Patent Number: 6,153,978

[45] Date of Patent: Nov. 28, 2000

[54] FIELD EMISSION COLD CATHODE DEVICE AND METHOD FOR DRIVING THE SAME

[75] Inventor: Akihiko Okamoto, Tokyo, Japan

[73] Assignee: NEC Corporation, Japan

[21] Appl. No.: 09/431,336

[22] Filed: Oct. 28, 1999

[30] Foreign Application Priority Data

Oct. 28, 1998 [JP] Japan ..... 10-306226

[51] Int. Cl.[7] ..... G09G 3/10

[52] U.S. Cl. ..... 315/169.3; 315/169.1; 345/74

[58] Field of Search ..... 315/169.3, 169.4, 315/169.2, 169.1, 336; 345/74, 77

[56] References Cited

U.S. PATENT DOCUMENTS

| | | | |
|---|---|---|---|
| 4,884,010 | 11/1989 | Biberian | 315/366 |
| 5,191,217 | 3/1993 | Kane et al. | 250/423 F |
| 5,742,267 | 4/1998 | Wilkinson | 345/77 |
| 5,780,318 | 7/1998 | Hirano et al. | 438/20 |
| 5,877,594 | 3/1999 | Miyano et al. | 315/169.1 |
| 5,929,557 | 7/1999 | Makishima et al. | 313/309 |
| 6,011,356 | 1/2000 | Janning et al. | 315/169.4 |
| 6,040,973 | 3/2000 | Okamoto et al. | 361/235 |
| 6,057,636 | 5/2000 | Sakai et al. | 313/306 |

FOREIGN PATENT DOCUMENTS

| | | | |
|---|---|---|---|
| 10-207416 | 8/1998 | Japan | G09G 3/22 |

*Primary Examiner*—Haissa Philogene
*Assistant Examiner*—Tuyet T. Vo
*Attorney, Agent, or Firm*—Hayes, Soloway, Hennessey, Grossman & Hage, P.C.

[57] ABSTRACT

In a field emission cold cathode device including one emitter, a supporting region formed of a conductor or a semiconductor for supporting the emitter, and a gate electrode provided in the proximity of the emitter, electrons are supplied to the emitter from a capacitance formed by a pair of electrodes separated from each other, one of the pair of electrodes being DC connected to the emitter. The emitted electron amount can be controlled by controlling a voltage applied to the other of the pair of electrodes. Thus, it is possible to minimize the variation in the emission current caused by variation in the emitter devices, which was unavoidable in the prior art.

17 Claims, 7 Drawing Sheets

FIELD EMISSION COLD CATHODE DEVICE AND METHOD FOR DRIVING THE SAME

BACKGROUND OF THE INVENTION

The present invention relates to a field emission cold cathode device and a method for driving the same, and more specifically to a field emission cold cathode device having an emitter and a gate electrode located in the proximity of the emitter, and a method for driving the same.

A field emission cold cathode includes a Spindt type having a conically sharpened emitter and a gate electrode having an opening on the order of sub-micron and formed in the proximity of the emitter so that a high electric field is concentrated on a tip end of the emitter so as to emit electrons from the tip end of the emitter in vacuum; a silicon cone type;

the type having an emitter formed of a material having a small work function and a gate electrode located in the proximity of the emitter so that electrons are emitted by applying a high electric field; and a surface conductive type having two electrodes separated from each other by a micro spacing so that when a current is flowed between the two electrodes, an electric discharge occurs in a spacing between the two electrodes, and when electrons collide against an opposing electrode, secondary electrons are emitted into vacuum.

On the other hand, an image display using the cold cathode device, for example, a field emission display (abbreviated to "FED" hereinafter) is so configured that phosphors of three primary colors (red, green and blue) are located to oppose the emitters in a vacuum space, so that emitted electrons are injected to the phosphor to cause the phosphor to emit light. Therefore, it is a self-light-emission display device, and therefore, the color characteristics does not change dependently upon a viewing direction.

In order to obtain a good image quality, it is necessary to control the brightness of respective pixels to a desired brightness in time and spatially. In the FED configured to cause the phosphor to emit light, the brightness is in proportion to the product of the amount "n" of emitted electrons injected into the phosphor constituting the pixel, and an accelerated voltage "Va".

In an ordinary case, if electron emission having a constant current amount I is generated, the brightness can be controlled by controlling an emission time "t". In this case, the brightness is in proportion to I•Va•t. In the FED, a plurality of emitters are collected to form a cold cathode device, and one cold cathode device is provided for each pixel corresponding to one color. Therefore, cold cathode devices of the number corresponding to the number of pixels are prepared, and individual emitters are controlled.

Incidentally, there is a method for applying an anode voltage to only a phosphor to be caused to emit light, so that the phosphor actually emits light. However, it is basically important to maintain the emission current of the cold cathode device at a constant in time and spatially.

For example, in the Spindt type, the emission current is controlled by controlling the voltage of the gate electrode positioned in. the proximity of the sharpened tip end of the emitter. The emitted current is determined by an electric field in the proximity of the sharpened tip end of the emitter and the work function of the surface of the sharpened tip end of the emitter, in accordance with the Fowler-Nordhiem equation.

The electric field is determined by a voltage applied to the gate electrode, a distance between the gate and the emitter, and the degree of sharpness on the tip end of the emitter. In the Spindt type, an opening of the gate electrode is formed to have a diameter of 0.5 $\mu$m to 2 $\mu$m. However, since the opening of the gate electrode is ordinarily formed by use of a light exposure process using a photoresist, the gate opening has a variation on the order of 10% from one emitter to another.

In addition, the degree of sharpness of the emitter tip end widely varies from one emitter to another. The work function of the surface depends upon a crystal orientation. The Spindt emitter is ordinarily formed by evaporation of molybdenum, but since the molybdenum is polycrystal, the crystal orientation on the emitter tip end cannot be controlled. Furthermore, the grain size on the emitter tip end reaches about 10 $\mu$m at maximum. As a result, the diameter of the emitter tip end widely varies.

The FED uses a cold cathode device obtained by collecting about 1000 emitters for one pixel. However, since the above mentioned variation occurs in the cold cathode devices, brightness unevenness occurs in the display. Furthermore, emission varies from one display to another.

The work function of the surface is widely different from one material to another. In particular, the work function greatly depends upon a material adhered on the surface and an oxidation condition of the surface. For example, when the emitter material is molybdenum, the work function is on the order of 4.5 eV in a metal condition, but as reported by E. Bauer and H. Poppa, Surf. Sci., 88, 31 (1979), increases by 2 eV when the surface is oxidized.

As mentioned above, the work function of the surface depends upon the crystal orientation. In the Spindt emitter, the crystal orientation on the emitter tip end cannot be controlled.

In the surface conductive type, the voltage applied between the two electrodes is controlled so as to control the current flowing through the two electrodes. The current amount is determined by the width of the narrow spacing between the two electrodes and the thickness of the electrodes. The width of the spacing between the two electrodes is controlled by a heat treating temperature of the electrodes and the time, but variation on the order of 5% occurs, with the result that the emission current varies.

Furthermore, in the FED having a fine gate or so constructed to apply an anode voltage of not less than 300V, an electric discharge accidentally occurs from matters adhered to the gate or the electrode. In the Spindt type, since a distance between the emitter and the gate electrode is very small, an electric discharge often occurs between the emitter and the gate electrode.

In order to prevent the above mentioned problem, it is ordinarily adopted to insert a high resistance between the emitter and a current supply so as to suppress the discharge. Ordinarily, an amorphous silicon layer or a high resistance polysilicon layer is formed on a glass substrate. However, the emission varies because variation in the length, the film thickness and the electric property of the resistor layer.

On the other hand, JP-A-10-207416 proposes an approach for suppressing the variation in the emission current. If a positive voltage is applied to the gate electrode, negative ions such as a residual gas. in an apparatus for driving the field emission cold cathode devices are attracted to the emitter and absorbed to the surface of the emitter, with the result that the emission current is decreased. JP-A-10-207416 is intended to overcome this problem. However, JP-A-10-207416 does not prevent the variation in the emission current caused by variation in emitter devices, namely variation from a field emission cold cathode device to another.

BRIEF SUMMARY OF THE INVENTION

Accordingly, it is an object of the present invention to provide a field emission cold cathode device and a method for driving the same, which has overcome the above mentioned problem of the prior art.

Another object of the present invention is to provide a field emission cold cathode device and a method for driving the same, capable of minimizing the variation in the emission current caused by variation in emitter devices.

The above and other objects of the present invention are achieved in accordance with the present invention by a field emission cold cathode device including at least one emitter, a supporting region formed of a conductor or a semiconductor for supporting the at least one emitter, and a gate electrode provided in the proximity of the at least one emitter, so that when the gate electrode is applied with a voltage higher than a voltage applied to the at least one emitter, electrons are emitted from the at least one emitter, and a control means for controlling the number of the electrons emitted from the at least one emitter.

According to another aspect of the present invention, there is provided a method for controlling a field emission cold cathode device including at least one emitter, a supporting region formed of a conductor or a semiconductor for supporting the at least one emitter, and at gate electrode provided in the proximity of the at least one emitter, so that when the gate electrode is applied with a voltage higher than a voltage applied to the at least one emitter, electrons are emitted from the at least one emitter, the method including controlling the number of the electrons emitted from the at least one emitter.

With the above mentioned arrangement, the variation in the emission current caused by variation in emitter devices can be minimized by controlling the number of the electrons emitted from the emitter.

The above and other objects, features and advantages of the present invention will be apparent from the following description of preferred embodiments of the invention with reference to the accompanying drawings.

DETAILED DESCRIPTION OF THE INVENTION

Now, the present invention will be described. In the prior art, in the case of controlling the emission current by means of the gate electrode, the emission amount varies because of variation in the characteristics of individual emitters and variation in the resistance component connected in series with the emitter, with the result that evenness is deteriorated.

Figure 1:
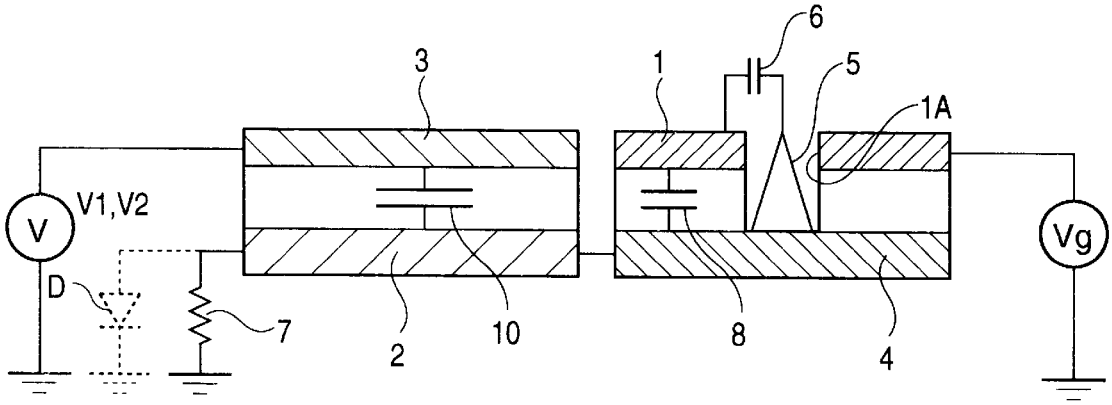
FIG. 1 is a diagrammatic sectional view illustrating a first embodiment of the field emission cold cathode device in accordance with the present invention.

Referring to FIG. 1, there is shown a diagrammatic sectional view illustrating a first embodiment of the field emission cold cathode device in accordance with the present invention. In FIG. 1, the reference number 1 designates a gate electrode, and the reference number 2 and 3 denote a electrode. The reference number 4 shows a supporting region or member 4 formed of a conductor or a semiconductor for supporting a conically sharpened emitter 5, which is located at a center of an opening 1A formed in the gate electrode 1. The reference number 7 indicates a resistor. The reference numbers 6, 8 and 10 designate a capacitance component between the gate electrode 1 and the emitter 5, a capacitance component between the gate electrode 1 and the supporting region 4, and a capacitance component between the electrodes 2 and 3, respectively.

The shown embodiment is characterized in that the capacitor 10 is connected to the emitter 5, so that electrons stored in the capacitor 10 are supplied to the emitter 5 so as to cause the emitter to emit the electrons.

In this operation, since the amount of emitted electrons is determined by a capacitance of the emitter 5 and the capacitance of the capacitor 10, the emission amount or the number of emitted electrons is substantially determined by these capacitance.

For example, in the Spindt emitter, the capacitance 6 between the gate electrode 1 and the tip end of the individual emitter 5 varies upon variation or unevenness in the diameter of the opening lA of the gate electrode. However, since the supporting region 4 supporting a base of the emitter 5 is formed of a conductive or semiconductive substrate or a conductive or semiconductive layer formed on an insulative substrate, the capacitor 8 is formed between the gate electrode 1 and the supporting region 4. The capacitance of the capacitor 8 can be made to be far larger than the capacitance 6 between the gate electrode 1 and the tip end of the individual emitter 5, with the result that the overall capacitance of the emitter has less variation or unevenness.

Furthermore, the capacitance 10 can be formed to have less variation or unevenness, and therefore, it is possible to control the variation or unevenness in the emitted electric charge amount or in an averaged current amount.

On the other hand, in a display using a phosphor, the brightness depends upon the product of the current amount and the accelerated voltage to the phosphor. However, because of an after-image effect of an eye, even if a pulsed current is periodically applied to the phosphor, the eye senses the brightness similar to the brightness generated when an averaged current is continuously applied to the phosphor.

Accordingly, in place of controlling the emission current by means of the gate voltage in the prior art, it is possible to control the brightness by controlling the number of electrons applied to the phosphor, and it is possible to obtain the brightness obtained by the averaged current, even if the phosphor is caused to periodically emit light.

In addition, the electric charge amount is controlled to be even in time and spatially, the evenness can be further elevated.

Now, the first embodiment of the field emission cold cathode device in accordance with the present invention, which is of the Spindt type, will be described with reference to In FIG. 1. The shown field emission cold cathode device includes the conically sharpened emitter 5 supported on the supporting region 4 formed of a conductor or a semiconductor. The gate electrode 1 is located in the proximity of the emitter 5 and has the opening lA surrounding the sharpened tip end of the emitter 5. The electrode 2 is DC-connected through the supporting region 4 to the emitter 5, and the electrode 3 is located to face the electrode 2, separately from the electrode 2. The resistor 7 is connected between the electrode 2 and a current supply or a constant voltage source, and has a resistance larger than a resistance component between the electrode 2 and the emitter 5.

A space between the electrodes 2 and 3 is maintained to be vacuum or filled with an insulating material, so that the capacitance 10 is formed between the electrodes 2 and 3. The capacitance 6 is formed between the gate electrode 1 and the emitter 5, and the capacitance is formed between the gate electrode 1 and the supporting region 4. In the following, explanation will be made assuming that the current supply or the constant voltage source is ground.

Figure 4:
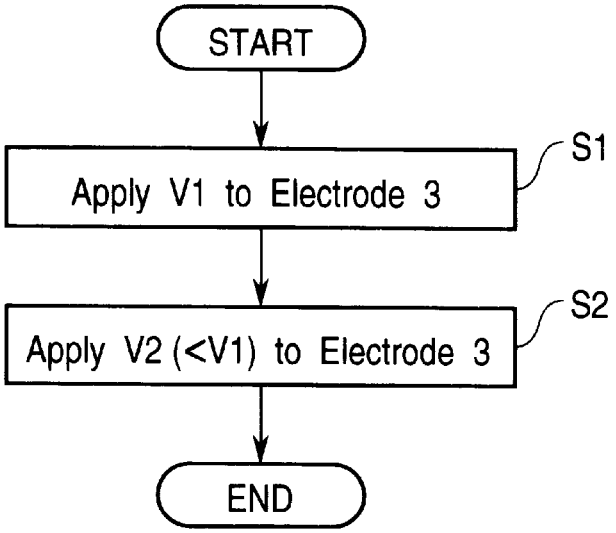
FIG. 4 is a flow chart illustrating a first embodiment of the field emission cold cathode device driving method in accordance with the present invention.

Now, a first embodiment of the field emission cold cathode device driving method in accordance with the present invention will be described with reference to FIG. 1 and FIG. 4. This first embodiment of the field emission cold cathode device driving method is a method for driving the first embodiment of the field emission cold cathode device shown in FIG. 1.

First, a voltage Vg is connected to the gate electrode 1, and a voltage V1 is applied to the electrode 3 (step S1), so that the field emission cold cathode device is maintained in a stationary condition. At this time, since the emitter 5, the supporting region 4 and the electrode 2 are DC-coupled and connected to the ground through the resistor 7, the emitter 5, the supporting region 4 and the electrode 2 are maintained at 0V.

In addition, the electrodes 2 and 3 are capacitively coupled by means of vacuum or a dielectric material therebetween. Therefore, when the voltage V1 is larger than the potential of the electrode 2, electrons are induced on the electrode 2.

Thereafter, a voltage V2 lower than the voltage V1 is applied to the electrode 2 (step S2). At this time, the electrons induced on the electrode 2 are discharged from the electrode 3 under the influence of the voltage V2. However, since the resistance 7 is larger than the resistance between the electrode 2 and the supporting region 4, the electrons are expelled to the supporting region 4. As a result, the potential of the supporting region 4 drops, so that if the sum of the voltage Vg and the amount of the voltage drop becomes larger than a minimum gate voltage Vgmin required for emission in the cold cathode, electrons are emitted from the tip end of the emitter 5.

With emission, the potential difference between the supporting region 4 and the gate electrode 1 becomes small, and when the potential difference becomes the voltage Vgmin, the electron emission terminates.

Here, assuming that the capacitance between the electrode 2 and 3 is C1, when the voltage of the electrode 3 is V1, the stored electric charge amount Q1 is expressed by C1·V1, and when the voltage of the electrode 3 is V2, the stored electric charge amount Q2 is expressed by C1·V2.

On the other hand, assuming that the capacitance between the supporting region 4 and the gate electrode 1 is Ce, when the gate voltage is Vg and the potential of the supporting region 4 is 0V, the stored electric charge amount Q3 is expressed by Ce·Vg, and when the potential difference between the gate electrode 1 and the supporting regions 4 is Vgmin, the stored electric charge amount Q4 is expressed by Ce·Vgmin.

Thus, the emitted electric charge amount Q is expressed as follows:

$$Q=C1\cdot(V1-V2)-Ce\cdot(Vgmin-Vg) \quad (1)$$

Since the electrode 2 is connected to the resistor 7, when the voltage of the electrode 3 is changed, a current flows through the resistor 7.

The equation (1) holds when this resistance of the resistor 7 is sufficiently larger than the resistance component between the electrode 2 and the emitter 5.

As seen from the equation (1), although the voltage Vg varies from one emitter to another, if the maximum value of the Vg is set to be lower than the voltage Vgmin, when the field emission cold cathode device is in the stationary condition while maintaining the electrode 3 at the voltage V1, no emission occurs.

On the other hand, if the voltage Vg is set to be as close to the voltage Vgmin as possible, and if the capacitance Ce is made to a small value, the value Ce·(Vgmin−Vg) can be made small. Therefore, it is possible to minimize the influence against the emitted electric charge amount, of the voltage Vgmin originating from the variation or unevenness of the emitter 5.

Furthermore, by enlarging the capacitance C1 and/or the voltage difference (V1−V2), it is possible to relatively minimize the variation of the voltage Vgmin.

Figure 5:
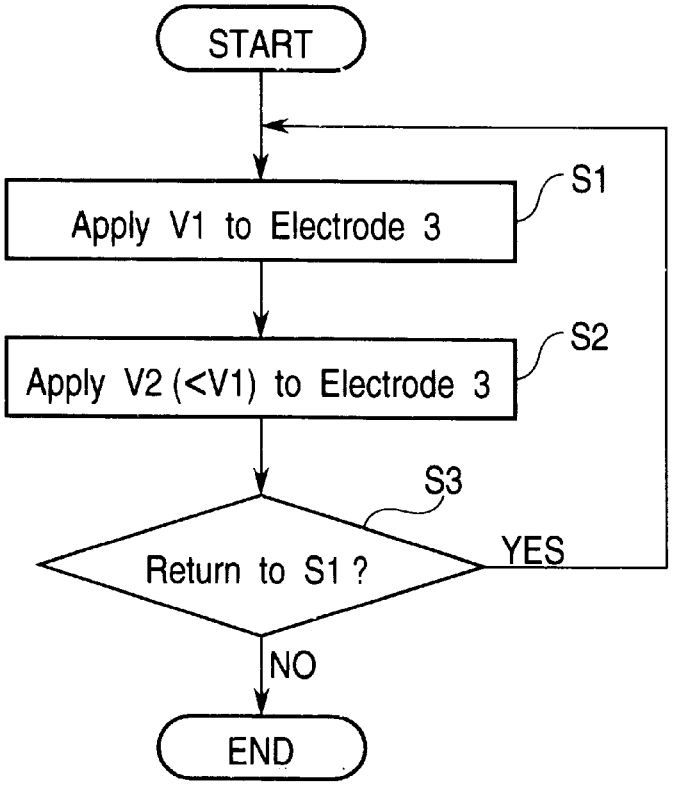
FIG. 5 is a flow chart illustrating a second embodiment of the field emission cold cathode device driving method in accordance with the present invention.

Next, a second embodiment of the field emission cold cathode device driving method in accordance with the present invention will be described. This second embodiment of the field emission cold cathode device driving method is another method for driving the first embodiment of the field emission cold cathode device shown in FIG. 1. FIG. 5 is a flow chart illustrating this second embodiment of the field emission cold cathode device driving method in accordance with the present invention. In FIG. 5, the steps corresponding to those shown in FIG. 4 are given the same reference characters, and explanation will be omitted.

Referring to FIG. 1 and FIG. 5, after the electrons are emitted from the emitter 5, if in the step S3, the operation returns to the step S1, the voltage V1 is applied again to the electrode 3. As a result, the electrons are supplied in the electrode 2 with elevation of the potential of the electrode 3. At this time, the electrons are not supplied from the supporting region 4 under the emitter 5, but the electrons are supplied through the resistor 7 from the ground (the current supply or the constant voltage source). The time for supplying the electrons depends upon the capacitance 10 and the resistor 7.

In the above mentioned embodiment, only one emitter 5 is provided, however, the above explanation can be applied when a plurality of emitters are provided.

In the embodiment shown in FIG. 1, the resistor 7 is connected between the electrode 2 and the ground (the current supply cr the constant voltage source). However, the resistor 7 can be replaced with a diode D connected between the electrode 3 and the ground (the current supply or the constant voltage source) to have a forward direction from the electrode 3 toward the ground (the current supply or the constant voltage source). In this modification, a similar operation can be obtained.

Furthermore, the voltage V1 and the voltage V2 applied to the electrode 3 are not necessarily required to be constant. It is allowed to freely change the voltage V1 and the voltage V2 in order to realize a desired change in time of the electron emission.

Now, a third embodiment of the field emission cold cathode device driving method in accordance with the present invention will be described with reference to FIG. 1, FIGS. 2A, 2B and 2C which are signal waveform diagrams for showing the variation in time of the voltage applied to an electrode 3, the emission current and the current flowing through a resistor 7, and FIG. 6 which is a flow chart illustrating the third embodiment the field emission cold cathode device driving method in accordance with the present invention. This third embodiment of the field emission cold cathode device driving method is a third method for driving the field emission cold cathode device shown in FIG. 1.

Figure 2A:
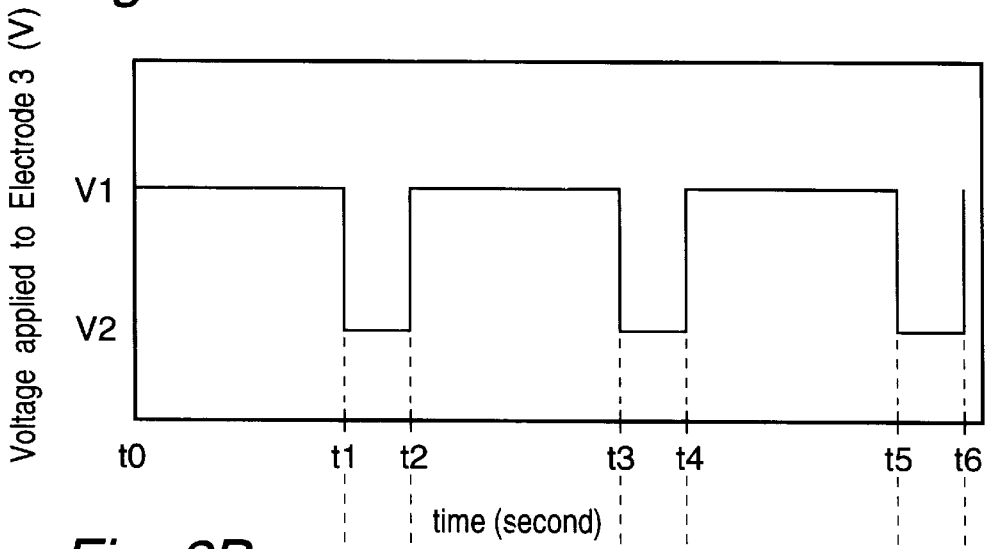
FIGS. 2A, 2B and 2C are signal waveform diagrams for showing the variation in time of the voltage applied to an electrode 3, the emission current and the current flowing through a resistor 7, in order to illustrate a third embodiment of the field emission cold cathode device driving method in accordance with the present invention.
Figure 6:
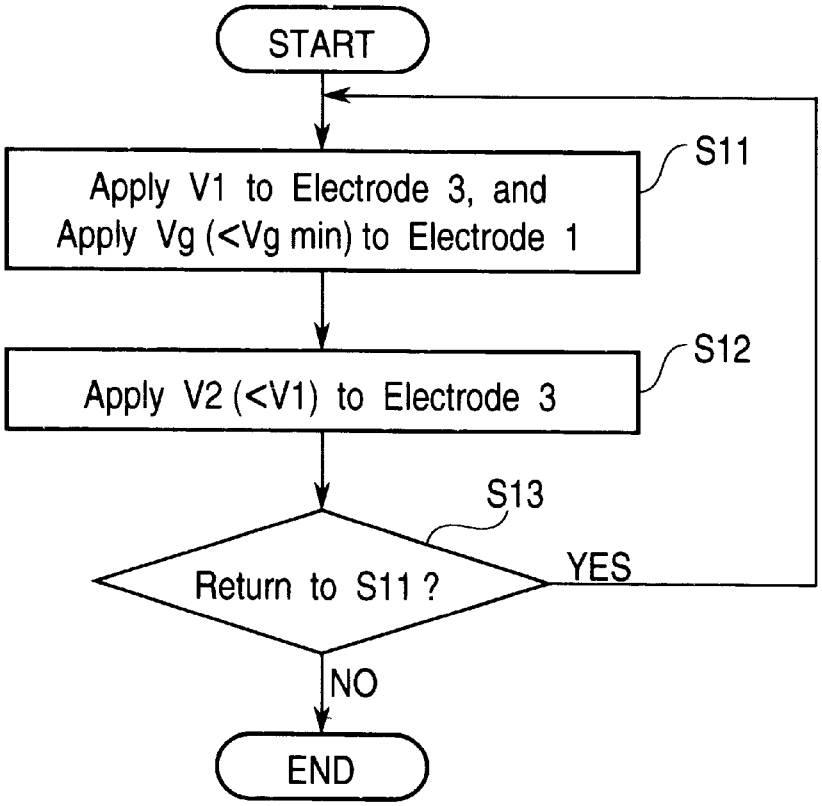
FIG. 6 is a flow chart illustrating the third embodiment the field emission cold cathode device driving method in accordance with the present invention.

Referring to FIG. 2A and FIG. 6, at a time t0, the voltage Vg is applied to the gate electrode 1, and the voltage V1 is applied to the electrode 3 (step S11).

Figure 2B:
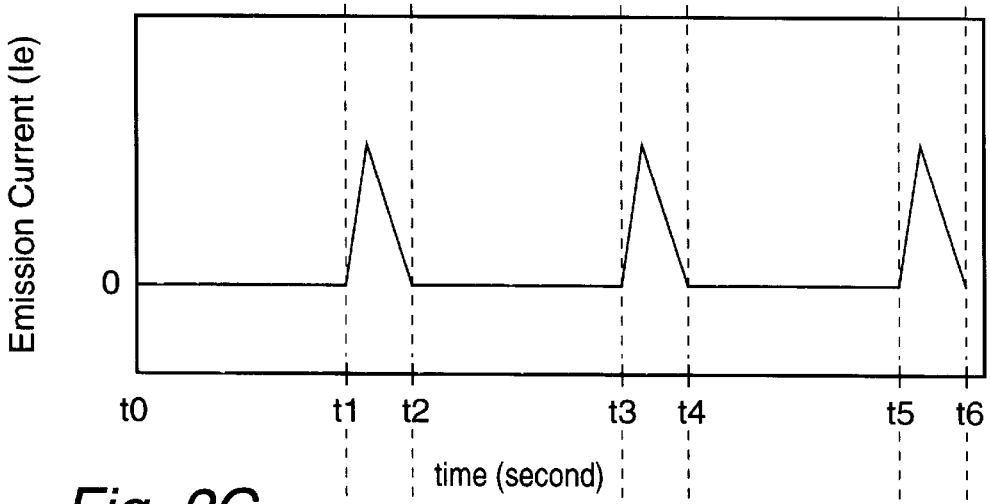
Figure 2C:
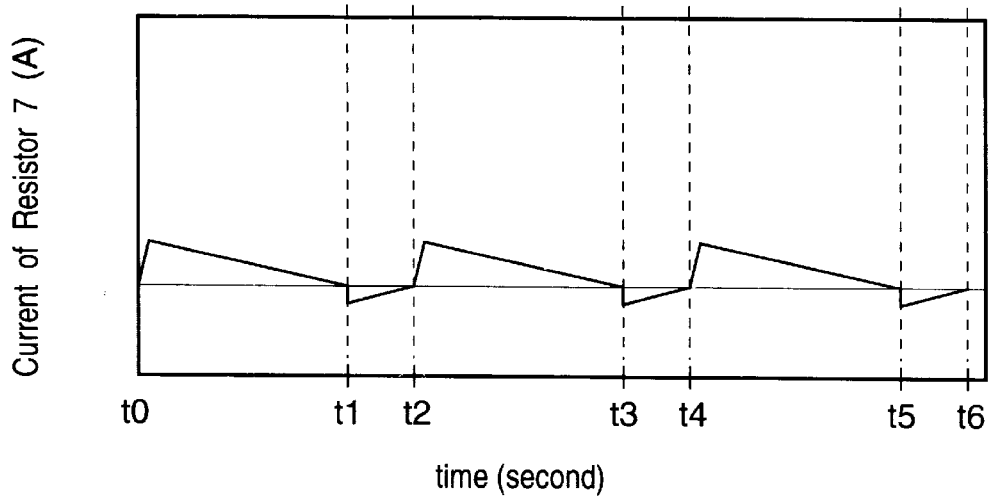

At this time, if the voltage Vg is smaller than the minimum gate voltage Vgmin required for emission in the cold cathode, no electron emission occurs, so that the emission current le becomes Ie=0 (FIG. 2B). On the other hand, at the same time as the voltage V1 is applied to the electrode 3, a current flows through the resistor 7 so as to charge the capacitance 10 (FIG. 2C).

Thereafter, the voltage applied to the electrode 3 is caused to drop to a voltage V2 (step S12 in FIG. 6, and a time t1 in FIG. 2A). As a result, the electrons stored in the capacitance 10 are expelled to a side having smaller resistance. If the potential difference between the gate electrode 1 and the emitter 5 becomes larger than the minimum gate voltage Vgmin, electrons are emitted from the tip end of the emitter 5, and therefore, the emission current Ie is observed (FIG. 2B). On the other hand, the current flowing through the resistor 7 is observed, however, since the resistor 7 has a large resistance, the current flowing through the resistor 7 is small (FIG. 2C).

Then, the voltage applied to the electrode 3 is returned to the voltage V1 (step S13 to step S11 in FIG. 6, and a time t2 in FIG. 2A). At this time, since a major portion of the electrons in the supporting region 4 under the emitter 5 has been already emitted, the supporting region 4 cannot supply a sufficient amount of electrons to bring the potential of the electrode 2 to the ground. Therefore, the electron emission terminates, and a small current starts to flow through the resistor 7 (FIG. 2B and FIG. 2C).

At this time, the change in time of the current flowing through the resistor 7 depends upon the capacitance of the device including the capacitance 10 and the resistance of the device including the resistor 7. The above mentioned operation from the step S11 to the step S13 is repeated to maintain the averaged current of the electrons periodically emitted from the emitter 5, at a constant value.

Next, a fourth embodiment of the field emission cold cathode device driving method in accordance with the present invention will be described with reference to FIG. 1, FIG. 3 which is a graph illustrating an emitted electric charge amount versus a voltage difference in this fourth embodiment the field emission cold cathode device driving method, and FIG. 7 which is a flow chart illustrating the fourth embodiment the field emission cold cathode device driving method in accordance within the present invention. This fourth embodiment of the field emission cold cathode device driving method is a fourth method for driving the field emission cold cathode device shown in FIG. 1.

Figure 3:
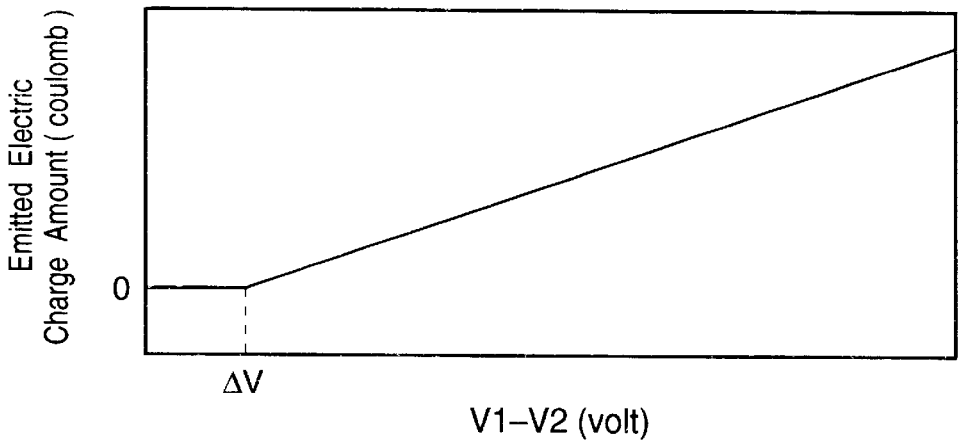
FIG. 3 is a graph illustrating an emitted electric charge amount versus a voltage difference in a fourth embodiment the field emission cold cathode device driving method in accordance with the present invention.

FIG. 3 illustrate the relation between the emitted electric charge amount and the voltage difference between the two voltages V1 and V2 applied to the electrode 3. Assuming that emission is obtained when the voltage difference (V1−V2) becomes higher than ΔV, the increased amount of the emitted electric charge amount is in proportion to the voltage difference (V1−V2) (FIG. 3). Accordingly, the emitted electric charge amount can be controlled by adjusting the two voltages V1 and V2.

In addition, since the following equation holds:

$$\Delta V=(Ce/C1)\cdot(Vgmin-Vg) \quad (2)$$

it is possible to control the emitted electric charge amount by adjusting the voltage Vg.

Figure 7:
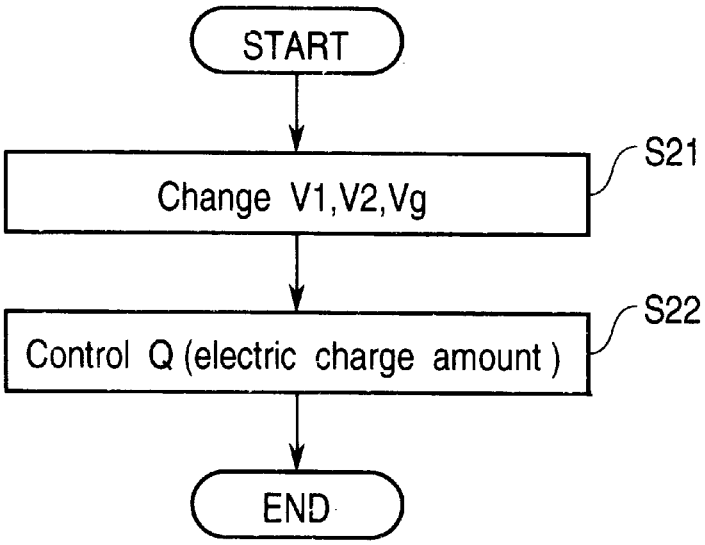
FIG. 7 is a flow chart illustrating the fourth embodiment the field emission cold cathode device driving method in accordance with the present invention.

Of course, it is possible to control the emitted electric charge amount by adjusting the voltages V1 and V2 and the voltage Vg in combination (steps S21 and S22 in FIG. 7). In particular, a tone can be expressed in the display by controlling the voltages.

Figure 8A:
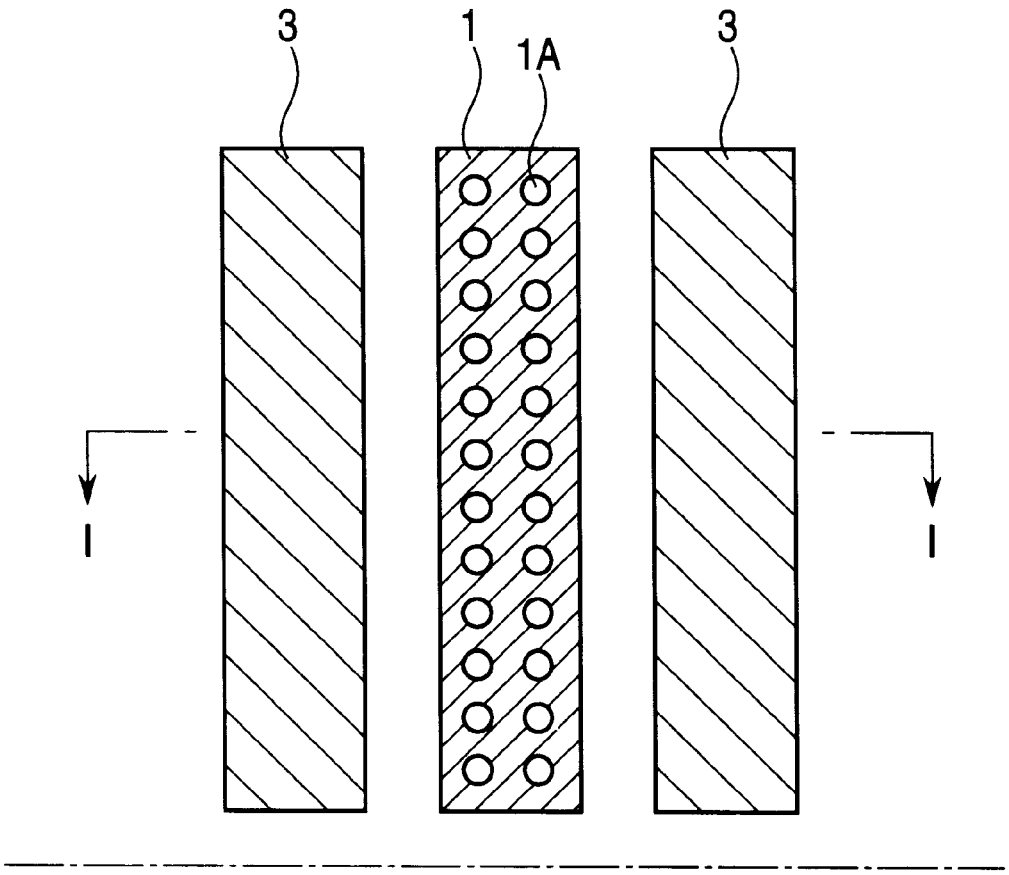
FIGS. 8A and 8B are a plan view and a section view taken along the line A—A in the plan view, for illustrating a second embodiment of the field emission cold cathode device in accordance with the present invention.
Figure 8B:
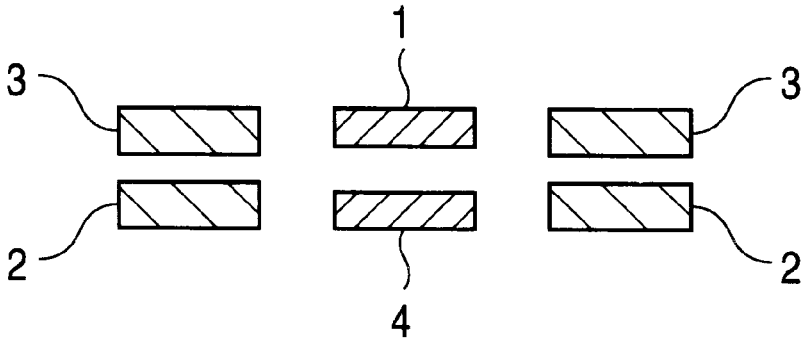

Now, a second embodiment of the field emission cold cathode device in accordance with the present invention will be described with reference to FIGS. 8A and 8B which are a plan view and a section view taken along the line A—A in the plan view, for illustrating the second embodiment of the field emission cold cathode device. In FIGS. 8A and 8B, elements similar in function to those shown in FIG. 1 are given the same reference numbers.

In this embodiment, a pair of electrodes 3 are located at both ;ides of a vertically elongated gate electrode 1 in the drawing, respectively and the electrode 2 is located at a substrate side of each of the electrodes 3. The gate electrode 1 includes a number of openings 1A, in each of which the emitter 5 is provided and supported by a supporting member 5. However, for simplification of the drawing, the emitter 5 is omitted in FIGS. 8A and 8B.

Similarly to the above mentioned embodiments, when the voltage applied to the electrode 3 is caused to drop to V2, the electrons , are expelled from the electrode 2 of the capacitor 10, and in the Spindt type, the electrons are emitted from the tip end of the emitters to have a spreading angle around a line extending from the tip end of the emitter in a direction perpendicular to the substrate.

Particularly, if the voltage V2 is smaller than the voltage Vg, the emitted electrons are forced back toward the perpendicular line by action of the voltage V2, so that the effective spreading angle becomes small.

When the field emission cold cathode device is used as an electron beam source in an image display, the diameter of an electron beam projected onto a screen is important. By making the effective spreading angle small, the diameter of the electron beam can be made small, with the result that high fine image can be obtained. Therefore, the electrode 3 can not only control the emitted electron amount but also can narrow the electron beam.

In the second embodiment of the field emission cold cathode device, the electrodes 2 are located on both sides of the emitter 5 and its supporting region 4. In this structure, the electrons stored in the electrodes can quickly flow into the center emitter 5, and therefore, it is possible to prevent the emission current from being concentrated to one emitter array of two emitter array, and therefore, to prevent the evenness and symmetry of the electron emission from being deteriorated.

Figure 9A:
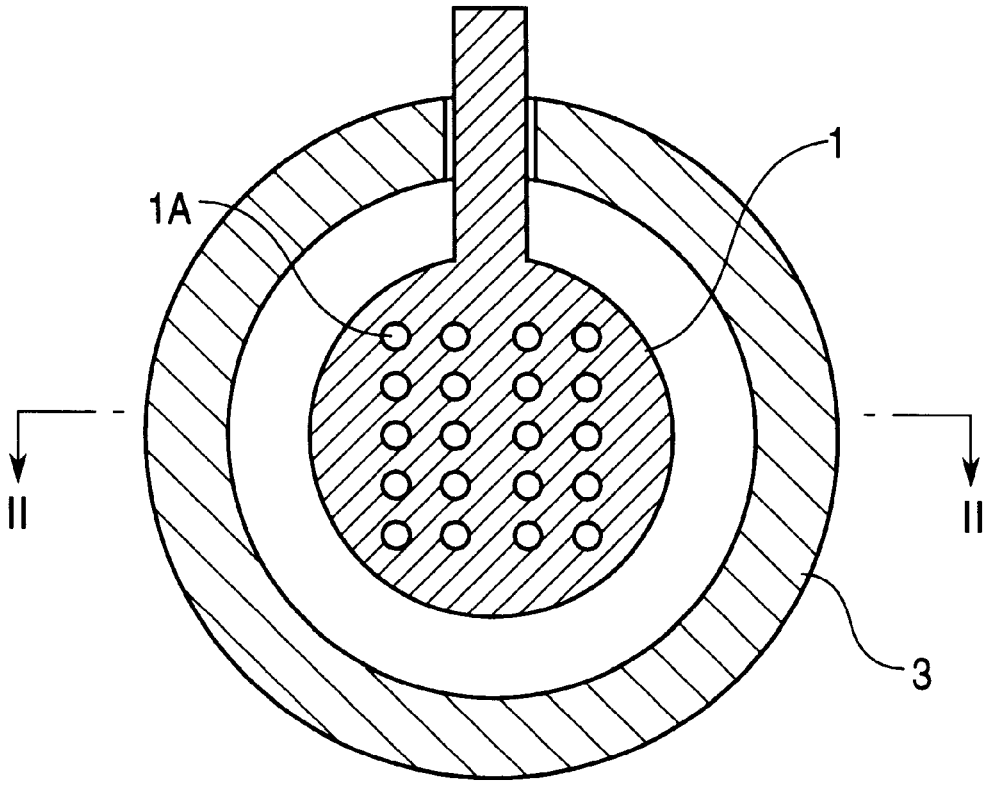
FIGS. 9A and 9B are a plan view and a section view taken along the line B—B in the plan view, for illustrating a third embodiment of the field emission cold cathode device in accordance with the present invention.
Figure 9B:
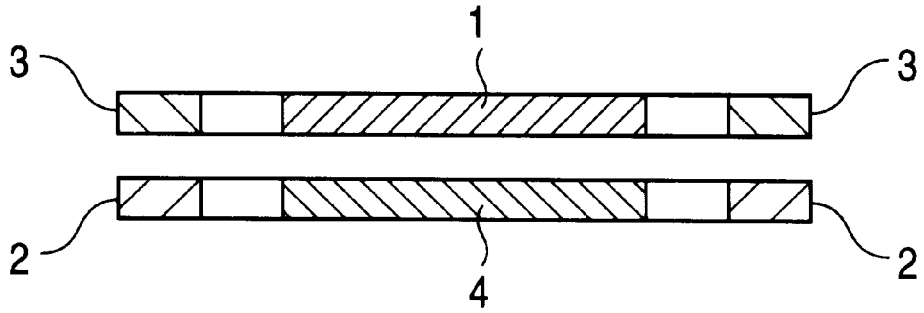

Next, a third embodiment of the field emission cold cathode device in accordance with the present invention will be described with reference to FIGS. 9A and 9B which are a plan view and a section view taken along the line B—B in the plan view, for illustrating the third embodiment of the field emission cold cathode device. In FIGS. 9A and 9B, elements similar in function to those shown in FIG. 1 and FIGS. 8A and 8B are given the same reference numbers.

In this embodiment, a circular gate electrode 1 is surrounded by an annular electrode 3, separately from the annular electrode 3. Since an operation of this embodiment is similar to that of the second embodiment of the field emission cold cathode device shown in FIGS. 8A and 8B, explanation will be omitted.

Figure 10:
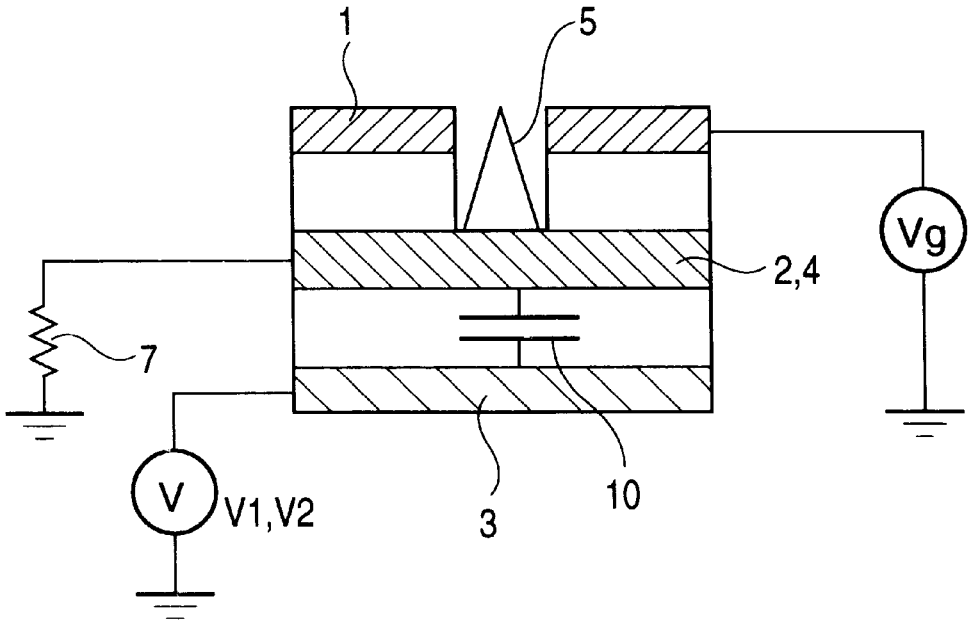
FIG. 10 is a section view taken for illustrating a fourth embodiment of the field emission cold cathode device in accordance with the present invention.

Now, a fourth embodiment of the field emission cold cathode device in accordance with the present invention will be described with reference to FIG. 10, which is a section view taken for illustrating the fourth embodiment of the field emission cold cathode device. In FIG. 10, elements similar in function to those shown in FIG. 1 are given the same reference numbers, and explanation will be omitted.

In this embodiment, the supporting region 4 under the emitter 5 and the gate electrode 1 functions as the electrode 2 in the first embodiment shown in FIG. 1. Under the region 4, the electrode 3 is located with a space between the region 4 and the electrode 3 being maintained in vacuum or filled with an insulating material. The region 4 is connected through the resistor 7 to the ground (as the current supply or the constant voltage source). Thus, this fourth embodiment of the field emission cold cathode device has a function similar to the first embodiment shown in FIG. 1.

Figure 11:
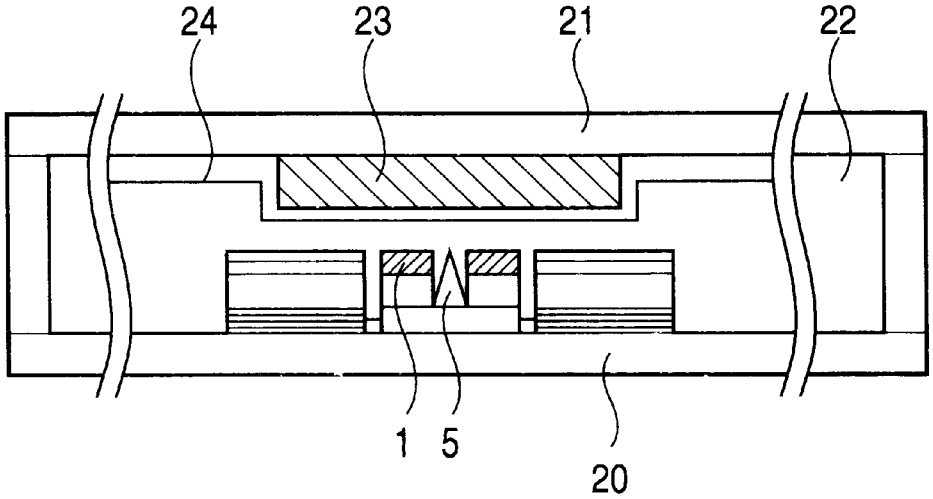
FIG. 11 is a section view taken for illustrating a portion of an image display incorporating the field emission cold cathode device in accordance with the present invention.

Next, an image display using the field emission cold cathode device in accordance with the present invention will be described with reference to FIG. 11 which is a section view taken for illustrating a portion of the image display. In FIG. 11, elements similar in function to those shown in FIG. 1 are given the same reference numbers, and explanation will be omitted.

The shown image display includes an emitter side panel 20 and a screen side panel 21 which are bonded to form a vacuum chamber 22. An inside of the chamber 22 is vacuum.

On an inside of the emitter side panel 20, a plurality of field emission cold cathode devices in accordance with the present invention are located, but only one field emission cold cathode device is shown for simplification of the drawing. On an inside of the screen side panel 21, a plurality of phosphors 23 are located to face the field emission cold cathode devices, respectively, but only one phosphor is show also for simplification of the drawing. An anode electrode 24 is formed to cover the phosphors 23 so that an anode voltage not less than 200V built not greater than 10KV can be applied to the phosphor 23.

With this arrangement, by periodically emitting a constant amount of electrons from the emitter 5, the emitted electrons are accelerated from the emitter towards the anode 24 so that the emitted electrons collide with the phosphor 23, with the result that the phosphor 23 emits light of tile color determined by the kind of the phosphor.

For example, if one color pixel is composed of one set of phosphors 23 of red, green and blue, and if a number of color pixels are arranged over the screen, a highly fine image can be formed.

In addition, the amount of emitted electrons is determined by the capacitance 10 as mentioned above, there does not occur a variation in the emitted current which was determined by the gate voltage in the prior art. The variation and unevenness in the amount of light emitted from the phosphor 23 are suppressed, so that an image of an uniform quality can be obtained.

Incidentally, the embodiments of the Spindt emitter applied with the present invention have been explained, but the present invention can be equally applied to an emitter using a low work function material such as diamond, and the surface conductive type emitter. Namely, if an electron emitting electrode or material is deemed as the emitter, and if an electrode or material for emitting secondary electrons is deemed is the gate electrode, a similar operation can be realized. In this case, even if electrons collide with an electrode or material for emitting electrons under an electric field, a similar operation can be realized.

As seen from the above, according to the present invention, the number of the electrons emitted from the emitter is controlled, it is possible to minimize the variation in the emission current caused by variation in the emitter devices, which was unavoidable in the prior art.

The invention has thus been shown and described with reference to the specific embodiments. However, it should be noted that the present invention is in no way limited to the details of the illustrated structures but changes and modifications may be made within the scope of the appended claims.

What is claimed is:

1. A field emission cold cathode device including at least one emitter, a supporting region formed of a conductor or a semiconductor for supporting said at least one emitter, and a gate electrode provided in the proximity of said at least one emitter, so that when said gate electrode is applied with a voltage higher than a voltage applied to said at least one emitter, electrons are emitted from said at least one emitter, and control means for controlling the number of said electrons emitted from said at least one emitter, wherein said control means includes a first electrode DC-connected through said supporting region to said at least one emitter, a second electrode located to face said first electrode, separately from said first electrode, to form capacitance between said first electrode and said second electrode, and a resistor connected between said first electrode and ground and having resistance larger than resistance between said first electrode and said at least one emitter.

2. A field emission cold cathode device claimed in claim 1 wherein said second electrode includes a plurality of second electrodes located to put said gate electrode therebetween.

3. A field emission cold cathode device claimed in claim 1 wherein said second electrode is of an annular electrode surrounding said gate electrode.

4. A field emission cold cathode device claimed in claim 1 wherein said first electrode includes a plurality of first electrodes located to put said at least one emitter therebetween.

5. A field emission cold cathode device claimed in claim 1 wherein said first electrode is of an annular electrode surrounding said at least one emitter.

6. A field emission cold cathode device claimed in claim 1 wherein said first electrode is integral with said supporting region.

7. A field emission cold cathode device including at least one emitter, a supporting region formed of a conductor or a semiconductor for supporting said at least one emitter, and a gate electrode provided in the proximity of said at least one emitter, so that when said gate electrode is applied with a voltage higher than a voltage applied to said at least one emitter, electrons are emitted from said at least one emitter, and control means for controlling the number of said electrons emitted from said at least one emitter, wherein said control means includes a first electrode DC-connected through said supporting region to said at least one emitter, a second electrode located to face said first electrode, separately from said first electrode, to form capacitance between said first electrode and said second electrode, and a diode connected between said first electrode and ground to have a forward direction from said first electrode toward said ground.

8. A field emission cold cathode device claimed in claim 7 wherein said second electrode includes a plurality of second electrodes located to put said gate electrode therebetween.

9. A field emission cold cathode device claimed in claim 7 wherein said second electrode is of an annular electrode surrounding said gate electrode.

10. A field emission cold cathode device claimed in claim 7 wherein said first electrode includes a plurality of first electrodes located to put said at least one emitter therebetween.

11. A field emission cold cathode device claimed in claim 7 wherein said first electrode is of an annular electrode surrounding said at least one emitter.

12. A field emission cold cathode device claimed in claim 7 wherein said first electrode is integral with said supporting region.

13. A method for controlling a field emission cold cathode device including at least one emitter, a supporting region formed of a conductor or a semiconductor for supporting said at least one emitter, a gate electrode provided in the proximity of said at least one emitter, a first electrode DC-connected through said supporting region to said at least one emitter, a second electrode located to face said first electrode, separately from said first electrode, to form capacitance between said first electrode and said second electrode, and resistor connected between said first electrode and ground and having resistance larger than resistance between said first electrode and said at least one emitter, so that when said gate electrode is applied with a voltage higher than a voltage applied to said at least one emitter, electrons are emitted from said at least one emitter, the method including a first step of applying a first voltage to said second electrode, and a second step of applying a second voltage smaller than said first voltage to said second electrode, thereby controlling the number of said electrons emitted from said at least one emitter.

14. A method claimed in claim 13 wherein said first step and said second step are alternately repeated.

15. A method claimed in claim 13 wherein said first step includes applying a third voltage lower than a minimum voltage required to emit electrons from said at least one emitter, to said gate electrode.

16. A method claimed in claim 13 wherein the number of said electrons emitted from said at least one emitter is controlled by changing said first, second and third voltages in combination.

17. An image display comprising a field emission cold cathode device including at least one emitter, a supporting region formed of a conductor or a semiconductor for supporting said at least one emitter, a gate electrode provided in the proximity of said at least one emitter, so that when said gate electrode is applied with a voltage higher than a voltage applied to said at least one emitter, electrons are emitted from said at least one emitter, and a control means for controlling the number of said electrons emitted from said at least one emitter, wherein said control means includes a first electrode DC-connected through said supporting region to said at least one emitter, a second electrode located to face said first electrode, separately from said first electrode, to form capacitance between said first electrode and said second electrode, and a resistor connected between said first electrode and ground and having resistance larger than resistance between said first electrode and said at least one emitter.

* * * * *

UNITED STATES PATENT AND TRADEMARK OFFICE

CERTIFICATE OF CORRECTION

PATENT NO. : 6,153,978
DATED : November 28, 2000
INVENTOR(S) : Okamoto

It is certified that error appears in the above-identified patent and that said Letters Patent is hereby corrected as shown below:

Column 12,
Line 3, insert -- a -- before "resistor".

Signed and Sealed this

Twenty-third Day of April, 2002

*Attest:*

*Attesting Officer*

JAMES E. ROGAN
*Director of the United States Patent and Trademark Office*